US006886386B1

(12) United States Patent
Cantrell

(10) Patent No.: US 6,886,386 B1
(45) Date of Patent: May 3, 2005

(54) PRESS BRAKE PUNCH TRANSFER CARRIAGE

(76) Inventor: Russell Cantrell, 833 N. Old Manor, Wichita, KS (US) 67208

( * ) Notice: Subject to any disclaimer, the term of this patent is extended or adjusted under 35 U.S.C. 154(b) by 161 days.

(21) Appl. No.: 10/339,136

(22) Filed: Jan. 9, 2003

(51) Int. Cl.[7] ..... B21J 13/08; B23Q 3/155

(52) U.S. Cl. ..... 72/446; 72/389.3; 483/29

(58) Field of Search ..... 72/446–448, 389.4, 72/389.3; 483/28, 29

(56) References Cited

U.S. PATENT DOCUMENTS

| | | | | |
|---|---|---|---|---|
| 4,188,815 A | * | 2/1980 | Mizushima | 483/29 |
| 5,146,774 A | * | 9/1992 | Smith | 72/446 |
| 5,366,431 A | * | 11/1994 | Smith et al. | 483/1 |
| 5,410,904 A | * | 5/1995 | Hirata et al. | 72/446 |
| 6,656,099 B1 | * | 12/2003 | Akami et al. | 483/29 |

FOREIGN PATENT DOCUMENTS

| | | | |
|---|---|---|---|
| JP | 2-220715 | * | 9/1990 |

* cited by examiner

*Primary Examiner*—Daniel C. Crane
(74) *Attorney, Agent, or Firm*—Kenneth H. Jack; Davis & Jack, LLC

(57) ABSTRACT

An apparatus for press brake punch transfer consisting of a carriage; a plurality of rollers supporting the carriage and facilitating lateral rolling motion of the carriage; a press brake punch support bed having rollers facilitating longitudinal press brake punch movement; a plurality of screw actuated telescoping quills interconnecting the press brake punch support bed and the carriage, the quills facilitating vertical movement of the press brake punch support bed; laterally paired and longitudinally extending walls defining in combination with the press brake punch support bed, a press brake punch support channel having a lateral width; and a plurality of jack screw actuators spanning between and interconnecting the laterally paired and longitudinally extending walls, the jack screws being adapted for alternately increasing and decreasing the press brake support channel's lateral width.

10 Claims, 6 Drawing Sheets

PRESS BRAKE PUNCH TRANSFER CARRIAGE

FIELD OF THE INVENTION

This invention relates to metal working press brake machinery. More particularly, this invention relates to apparatus adapted for carrying press brake punches and press brake dies to and from die and punch storage racks, and to and from press brake machines.

BACKGROUND OF THE INVENTION

A press brake punch, when in use, is typically mounted within a press brake machine's upper shoe. Press brake punches commonly have a longitudinally elongated and upwardly extending ridge or tang which is fitted for nesting upward extension into a downwardly opening longitudinally elongated channel within the press brake machine's upper shoe. Such tang is typically fixedly clamped within such channel. Such mounting of a press brake punch upon a press brake machine extends the press brake punch downwardly and downwardly orients the generally convex metal working face of the punch.

Press brake punches are commonly heavy and cumbersome, and are advantageously conveyed to and from press brake machines, and to and from storage racks by means of specially adapted carriages. Since press brake punches are typically installed within press brake machines in the above described "tang up" orientation, such carriages are preferably capable of carrying a press brake punch in a similar orientation. However, the typically convex metal working face of a press brake punch gives rise to difficulties in situating such punch upon a carriage with the desired "tang up" orientation. For example, where the metal working face of a press brake punch is adapted to form a "V", and where the carriage includes a generally horizontal punch carrying bed, the press brake punch is difficultly or impossibly balanced in an upright position upon such bed. The point of the "V" shaped working face of such punch results in an unstable equilibrium, resulting in lateral toppling of the press brake punch. As another example, a press brake punch having a "U" shaped metal working face will similarly topple.

Another characteristic of common press brake punches which creates difficulties in achieving the desired "tang up" orientation upon a carriage is the lateral width of the punch. Press brake punches have widely varying lateral widths. Where the carriage's press brake punch carrying bed is laterally bounded by longitudinally extending stops or walls for prevention of toppling of a press brake punch, the varying widths of press brake punches complicates the lateral positioning of such walls or stops. Fixed placement of such walls or stops undesirably prevents some thick press brake punches from being carried, and undesirably allows lateral angular leaning of some thin press brake punches.

In order to ameliorate or compensate for press brake punch carrying problems arising from varying punch thicknesses, press brake punch carriages are known to incorporate multiple load beds, each being bounded by laterally paired and longitudinally extending walls which define multiple punch supporting channels. Yet, adaptation of a press brake punch carriage to include multiple varying width channels gives rise to other functional deficits, including cumbersomeness, excessive bulk, and lack of space economy of the carriage, misfitting and angular tilting of punches carried, and difficulty in manually reaching and accessing press brake punches carried by such carriage.

The instant invention overcomes or ameliorates the problems and deficiencies discussed and described above by providing a press brake punch transfer carriage having a single easily accessible press brake punch load bed, such load bed being bounded by laterally paired and longitudinally extending stops or walls for prevention of press brake punch toppling, the carriage incorporating mechanical means for adjusting the lateral displacement of such stops or walls for accommodation of press brake punches having varying widths.

BRIEF SUMMARY OF THE INVENTION

A first major structural component of the instant inventive apparatus for press brake punch transfer comprises a carriage which is preferably configured as a rigid steel box frame. The base of the carriage preferably is rectangular in shape, having longitudinally extending lateral front and back sides, and having relatively short laterally extending longitudinal ends. Preferably, the rectangular base rests upon and is supported by wheels positioned for facilitating lateral rolling motion of the frame. The wheels preferably comprise annular outwardly extending flanges for engaging floor mounted roller tracks. Suitably, though less desirably, the rectangular base may rest upon slide skids formed of low friction, high density, polyethylene plastic (HDPE plastic) for facilitating sliding motion of the carriage over slide tracks or smooth floor surfaces. The flanged wheels or skids upon which the frame is mounted comprise a first conveying means capable of facilitating lateral movement of the frame, along with structures carried by the frame, between press brake machines and press brake die and punch storage racks.

A second major structural component of the instant invention comprises a longitudinally elongated press brake punch support bed. Bed mounting means are necessarily provided, such means mechanically interlinking the press brake punch support bed and the carriage frame. Preferably, the bed mounting means comprises a pair of screw actuated telescoping quills extending vertically downward from a lower surface of the press brake punch support bed, the lower ends of the quills preferably being mounted upon and supported by base frame cross members of the carriage frame. The preferred screw actuated telescoping quills are actuatable for selective upward and downward motion by a reversible electric motor. Suitably, though less desirably, other rectilinear motion actuators just as jack screw assemblies, hydraulic cylinders, pneumatic cylinders, rack and pinion assemblies, scissor jacks, cam actuator assemblies, non-circular gear assemblies, and winch lifts may serve as a substitute for the preferred screw actuated telescoping quills. The rectilinear motion actuators which function as bed mounting means comprise second conveying means facilitating vertical motion of press brake punches carried by the carriage.

Third conveying means for facilitating longitudinal motion of a press brake punch which is carried upon the press brake punch support bed are necessarily provided, such means preferably comprising a plurality of rollers extending along the press brake punch support bed, the rollers preferably being rotatably mounted and oriented so that their axes of rotation extend laterally. Suitably, though less desirably, the third conveying means may comprise simple skids for facilitating sliding longitudinal motion of such press brake punch. Where the third conveying means comprises a skid or skids, HDPE plastic preferably serves as the slide surface.

In order to prevent press brake punches which rest upon the rollers or skids of the press brake punch support bed from toppling laterally, a plurality of stops are necessarily provided, the stops being capable of impinging upon lateral side walls of a press brake punch and capable of resisting lateral toppling movement. The plurality of stops, in combination with the press brake punch support bed, form and define an upwardly opening press brake punch support channel having a lateral width. The plurality of stops preferably comprise laterally paired and longitudinally extending punch supporting walls. Suitably, though less desirably, the stops may comprise laterally paired and longitudinally extending series of punch supporting pins or posts.

In order to allow the press brake punch support channel, which is defined by the plurality of stops, to accommodate varyingly sized press brake punches, channel width adjusting means operatively connected to at least one of the stops are necessarily provided. Where the plurality of stops comprises the preferred laterally paired walls, a preferred channel width adjusting means comprises a plurality of jack screws spanning between the walls, the jack screws operatively increasing and decreasing the width of the channel defined by the walls. Where the channel width adjusting means comprises the preferred jack screws, the jack screws are preferably manually operated by crank driven sprockets, the sprockets preferably being mechanically linked for simultaneous motion by closed looped drive chains. Other rectilinear motion actuators, such as screw actuated telescoping quills, hydraulic cylinders, pneumatic cylinders, rack and pinion assemblies, scissor jacks, cam actuator assemblies, and non-circular gear assemblies may suitably, though less desirably, alternately serve as channel width adjusting means.

In operation of the above described preferred embodiment of the instant inventive apparatus for press brake punch transfer, and assuming that a first press brake punch mounted upon a press brake machine is to be interchanged with a second press brake punch stored upon a rack, the press brake machine is initially operated to lower the first press brake punch to a point at which it rests upon an underlying press brake die. Thereafter, clamp screws of the upper shoe of the press brake machine are loosened, readying the first press brake punch for longitudinal sliding off loading. Thereafter, the inventive carriage is rollably moved laterally until the press brake punch support bed aligns laterally with the first press brake punch. Thereafter, the motor driven screw actuated telescoping quills are actuated to raise the press brake punch support bed to an elevation which aligns the upper surfaces of the bed's rollers with the lower most surface of the first press brake punch. Thereafter, the first press brake punch is manually longitudinally slidably moved toward the rollers until an end of the first press brake punch overlies a first roller. Thereafter, the channel width adjusting jack screws are manually manipulated until the laterally opposed walls contact the side walls of the first press brake punch. Thereafter, the first press brake punch is further longitudinally slidably and rollably moved until it is offloaded from the press brake machine and is entirely supported wholly by the carriage. Thereafter, the carriage is rollably moved laterally away from the press brake machine and toward a press brake punch and die storage rack.

Offloading the first press brake punch from the carriage onto such rack may be accomplished through a reversal of steps outlined above. Similar sequences of steps accomplishes a transfer of the second press brake punch from such rack to the carriage, and thence to the press brake machine, completing the press brake punch interchange process.

The inventive carriage, as described above, may be similarly utilized for transfers of press brake dies between storage racks and lower shoes of press brake machines. However, in order to reduce repetitions of movement of the carriage between storage racks and a press brake machines, the instant inventive carriage preferably further comprises a press brake die support bed configured similarly with the press brake punch support bed. Since press brake dies are typically installed "tang down" upon the lower shoe of a press brake machine, such dies may rest in stable equilibrium, without toppling, upon rollers or skids of such bed. Accordingly, channel width adjusting means are not necessarily associated with the press brake die support bed. Typically, the lower press brake die receiving shoe of a press brake machine remains at a fixed elevation. Accordingly, the rollers or skids of the carriage's press brake die support bed may be fixedly mounted at an identical elevation.

It is, therefore, an object of the present invention to provide a press brake punch transfer carriage which is capable of receiving and accommodating press brake punches having varying lateral widths through the provision of channel width adjusting means.

It is a further object of the present invention to provide such carriage which incorporates press brake punch conveying means facilitating lateral, longitudinal, and vertical movement of press brake punches.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
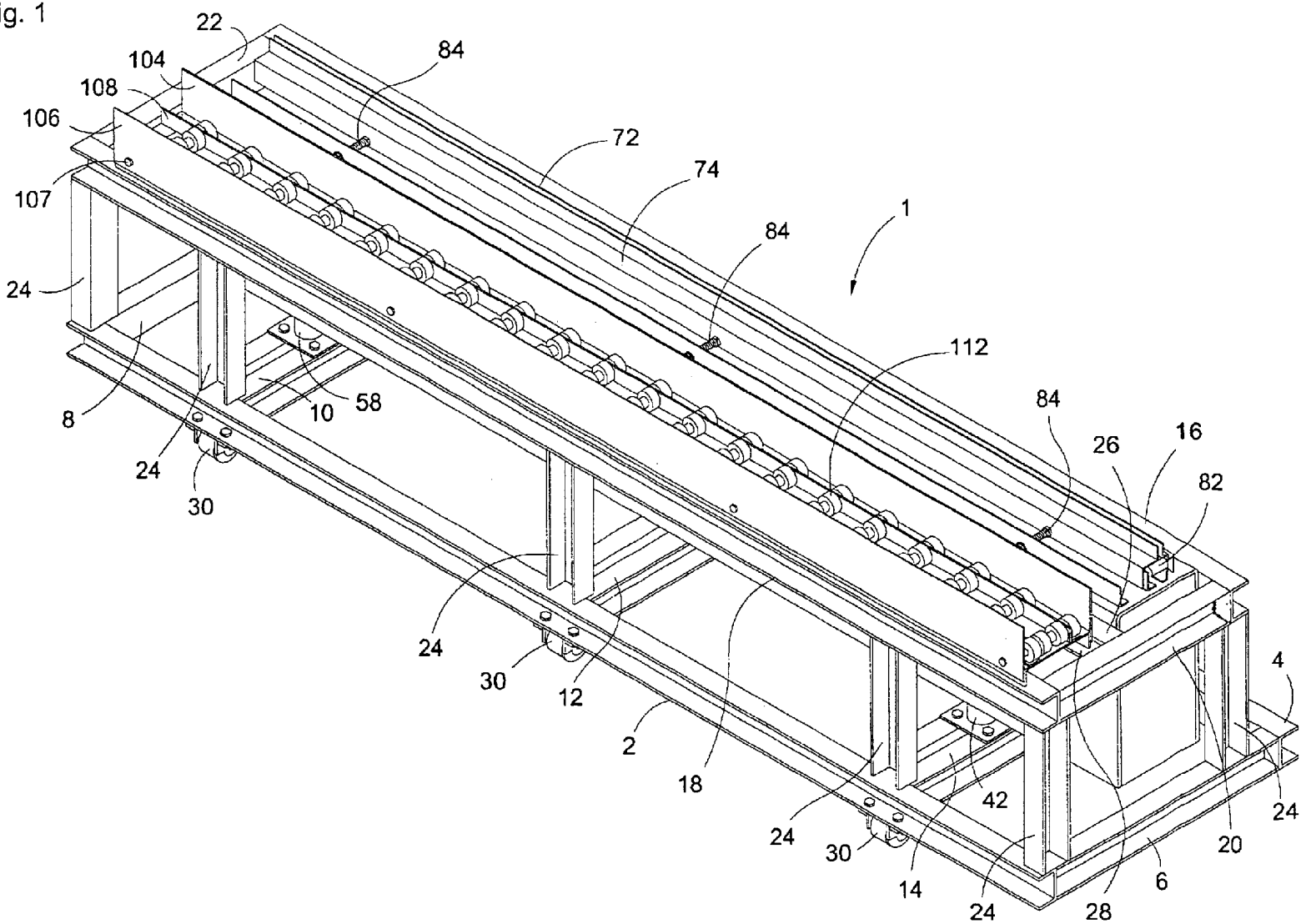
FIG. 1 is an isometric view of the instant inventive press brake punch transfer carriage.

Referring now to the drawings, and in particular to FIG. 1, the instant inventive press brake punch transfer carriage is referred to generally by Reference Arrow 1. The carriage 1 has a rectangular base frame, including longitudinally extending members 2 and 4, laterally extending end members 6 and 8, and laterally extending cross members 10, 12, and 14. A plurality of support columns 24 extend vertically upward from said base frame, the upper ends of the support columns 24 supporting an upper rectangular frame including longitudinally extending members 8, 16, and 18, and laterally extending end members 20 and 22.

Figure 2:
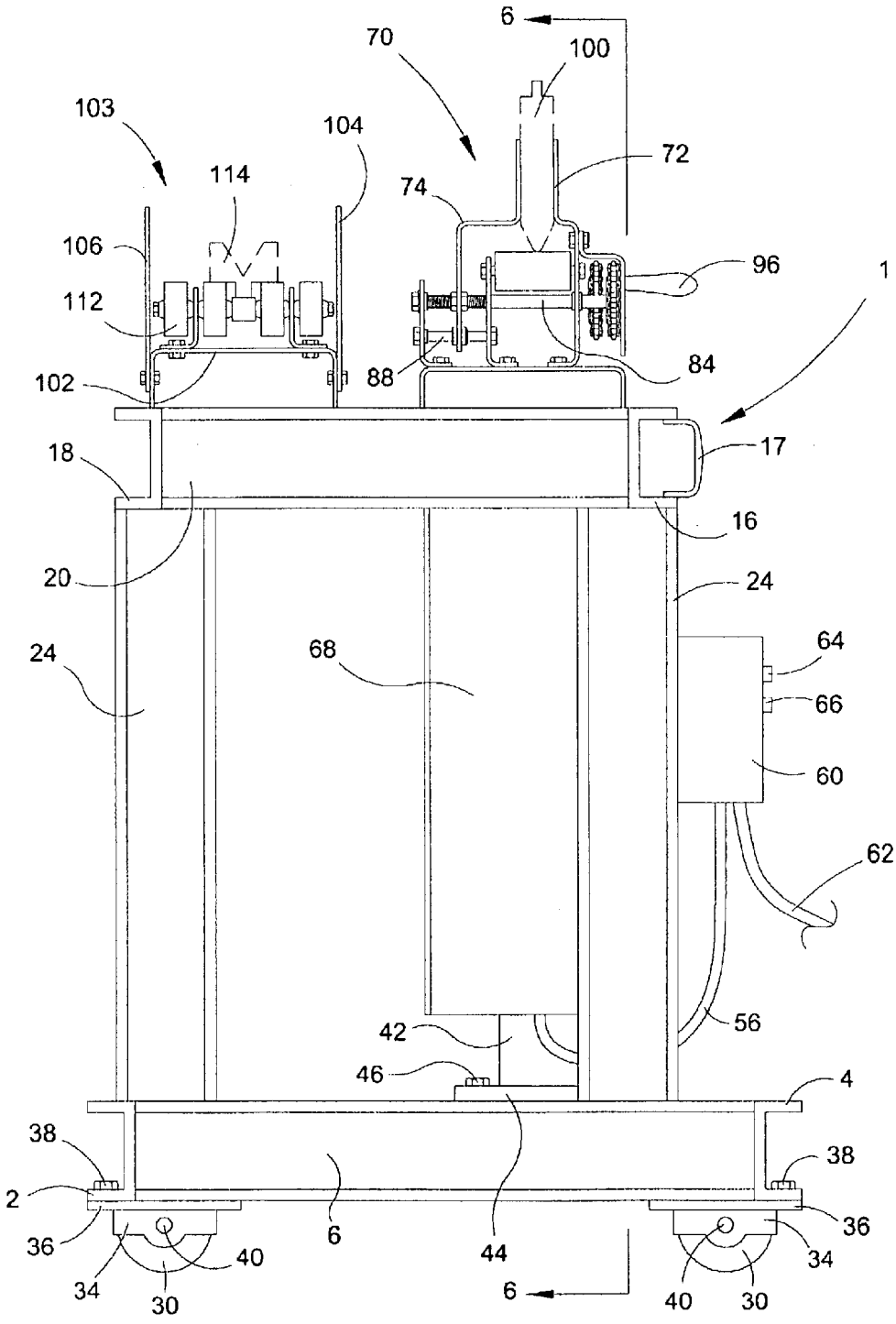
FIG. 2 is an end view of the apparatus depicted in FIG. 1.
Figure 6:
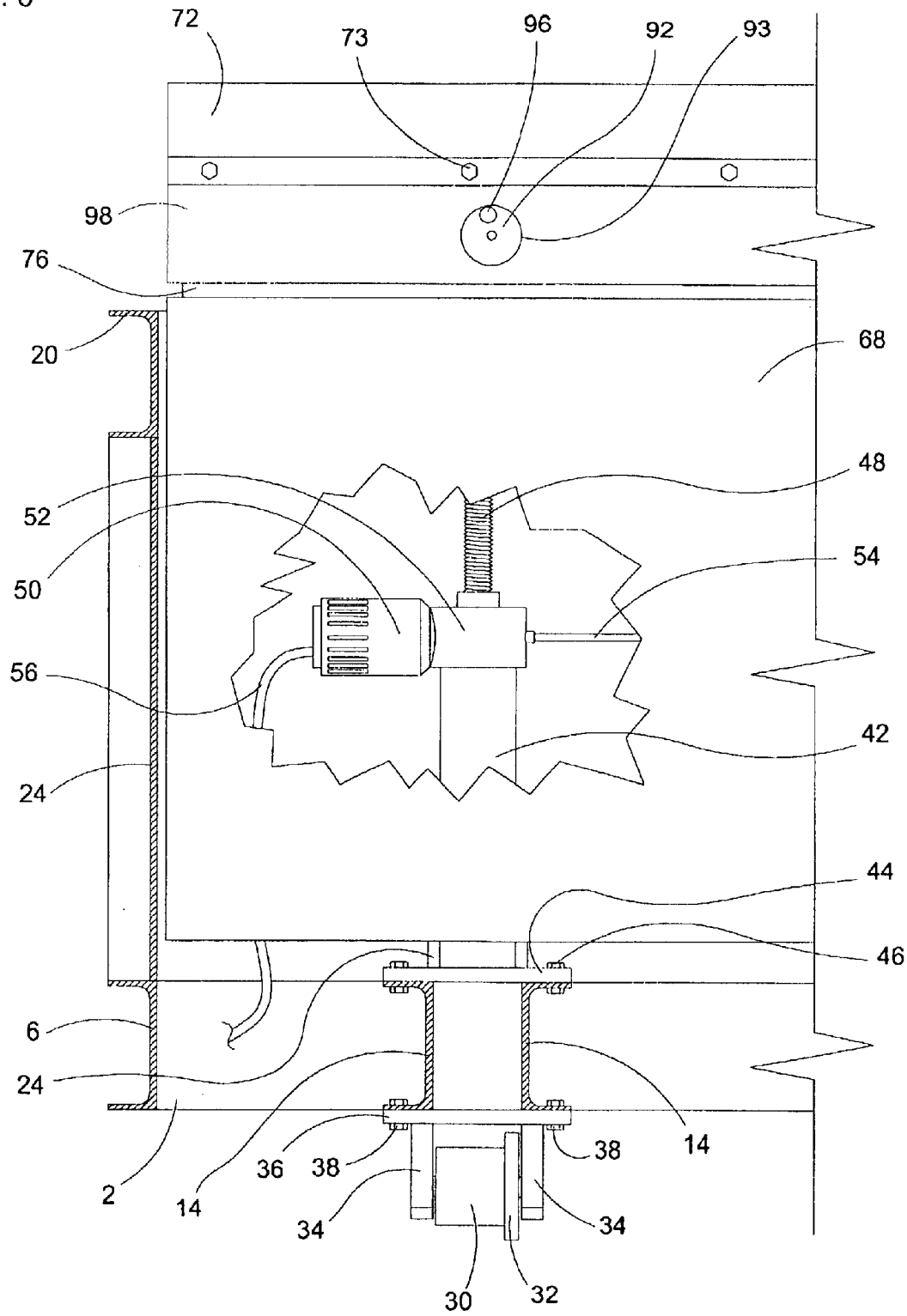
FIG. 6 is a partial side view of the apparatus depicted in FIG. 1, the view including a cut away section exposing and depicting a motor driven screw actuated telescoping quill.

Referring simultaneously to FIGS. 1, 2, and 6, the base frame is rollably supported by a plurality of wheels 30, the wheels preferably having radial flanges 32 for engaging floor tracks (not depicted). The wheels 30 are preferably rotatably mounted upon axles 40, the axles being supported by devises 34 which extend downwardly from mounting plates 36, the mounting plates being fixedly attached to the base frame by bolts 38. The axles 40 of wheels 30 are preferably longitudinally aligned for facilitating lateral rolling motion of the carriage between press brake punch and die storage racks (not depicted) and press brake machines (not depicted). Handles 17 are provided for manually laterally rolling the carriage 1.

Figure 3:
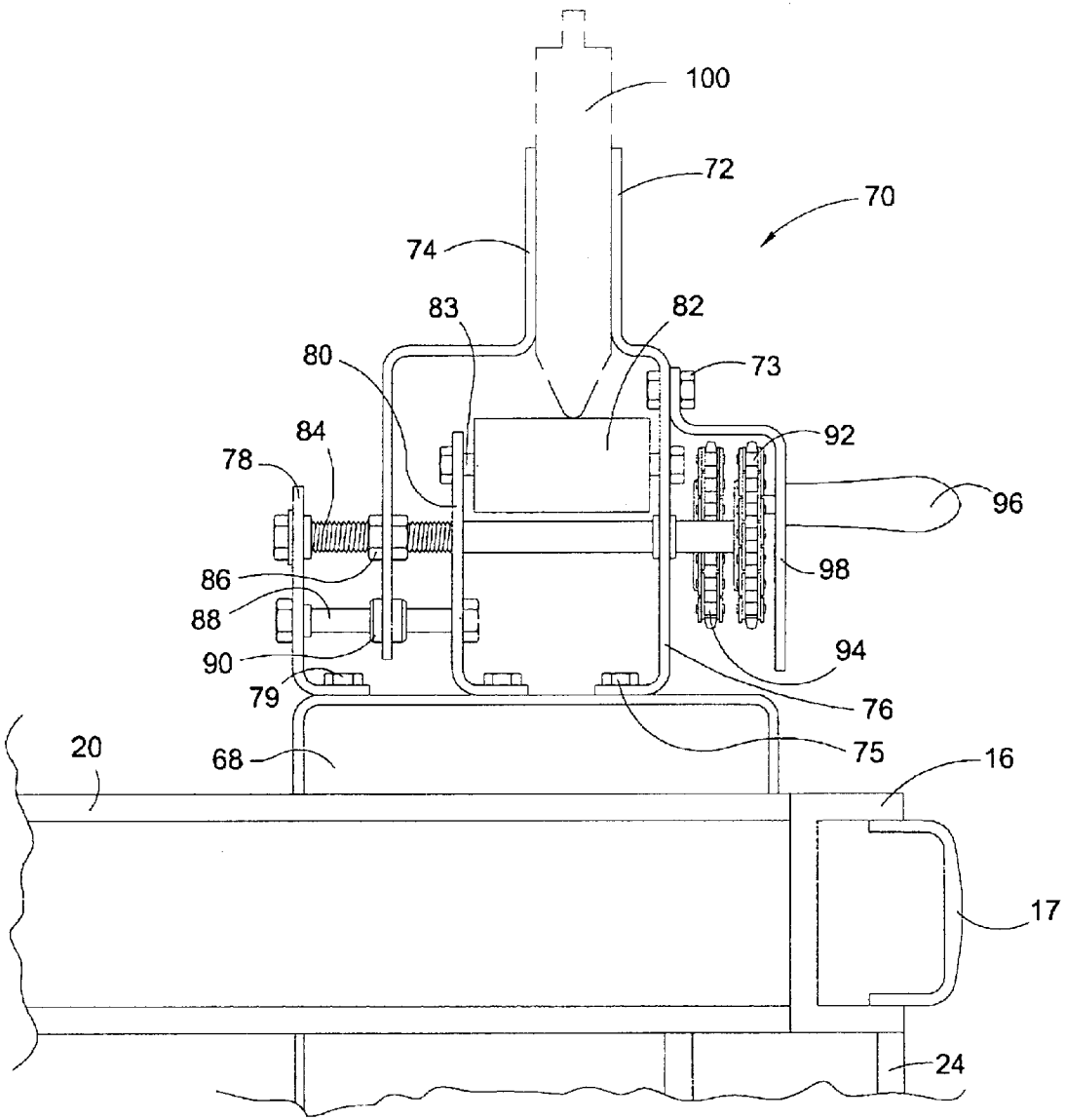
FIG. 3 is a magnification of a portion of FIG. 2.

Referring simultaneously to FIGS. 1, 2, and 3, a press brake punch bed is referred to generally by Reference Arrow 70, such bed including a downwardly opening box housing 68, roller supporting flanges 76 and 80, such flanges being fixedly attached to the box housing 68 by bolts 75, and a plurality of rollers 82 rotatably mounted upon flanges 76 and 78 by axles 83. Referring simultaneously to FIGS. 1, 2, and 6, telescoping quills 42 and 58 mount the press brake punch bed 70 upon cross members 14 and 10. The lower ends of telescoping quills 42 and 58 are preferably fixedly attached to cross members 14 and 10 by mounting plates 44 anchored by bolts 46. Each telescoping quill 42 and 58 preferably comprise a vertically extendable and retractable helically threaded shaft 48 and helically threaded nuts (not depicted within view) housed within enlarged housings 52 at the upper ends quills 42 and 58. A reversible electric motor 50 powered and controlled by electric cable 56 selectively drives the helically threaded shafts 48 of quills 42 and 58 directly as depicted in FIG. 2, and via a laterally extending power transfer shaft 54. An electric power cord 62 extending to an electric junction and switching box 60 is preferably provided, the power and control cable 56 extending from said junction box 60 to motor 50. Upon pressing of "up" button 64, the reversible electric motor 50 actuates both telescoping quills 42 and 58 to drive the press brake punch bed 70 upward. Alternately, pressing the "down" button 66 downwardly retracts the press brake punch support bed 70. An intermediate longitudinally extending upper member 26 in combination with longitudinally extending member 16 and laterally extending end members 20 and 22 guide and support the press brake punch bed 70, as such bed vertically travels.

Referring to FIG. 3, stops in the form of laterally opposed and longitudinally extending walls 72 and 74 are provided, such walls in combination with the press brake punch load bed 70 forming and defining a channel for receiving and supporting a press brake punch 100. Wall 72 preferably comprises a vertical extension of support flange 76. Means for adjusting the lateral width of such punch supporting channel are necessarily provided, such means preferably comprising three jack screw assemblies, each including a helically threaded shaft 84, such shaft passing through an aperture within and being fixedly and rotatably mounted upon support flange 76. The shafts 84 preferably extend laterally through apertures within support flange 80 for threaded engagement with a helically threaded nuts 86, the opposite ends of shafts 84 being fixedly and rotatably mounted upon support flange 78, which is mounted by bolts 79 to box frame housing 68. The helically threaded nuts 86 are preferably mounted fixedly within apertures within wall 74. Rotation and counter-rotation of shaft 84 adjusts the lateral positioning of both nut 86 and wall 74 carried by nut 86. A plurality of slide shafts 88 and slide sleeves 90 mounted upon wall 74 and upon longitudinally extending support flanges 83 and 78 enhance the stability of wall 74, while facilitating adjustment of said wall's lateral position.

Referring simultaneously to FIGS. 3 and 6, a radially tined sprocket 92 is preferably fixedly mounted upon helically threaded shaft 84, and turn handle 96 is preferably mounted upon and extends laterally from a side wall surface of sprocket 92. Upon rotation of sprocket 92, continuous loop drive chains 94 and 95, which are mechanically linked to the other two helically threaded shafts 84, similarly rotate said shafts, allowing the three jack screw assemblies to keep the punch supporting walls 72 and 74 in parallel alignment during lateral positional adjustment.

Referring further simultaneously to FIGS. 3 and 6, a longitudinally extending chain guard 98 is preferably mounted upon the lateral side wall of support flange 76 by bolts 73, the chain guard 98 preferably having a circular aperture 93, through which handle 96 extends.

Figure 4:
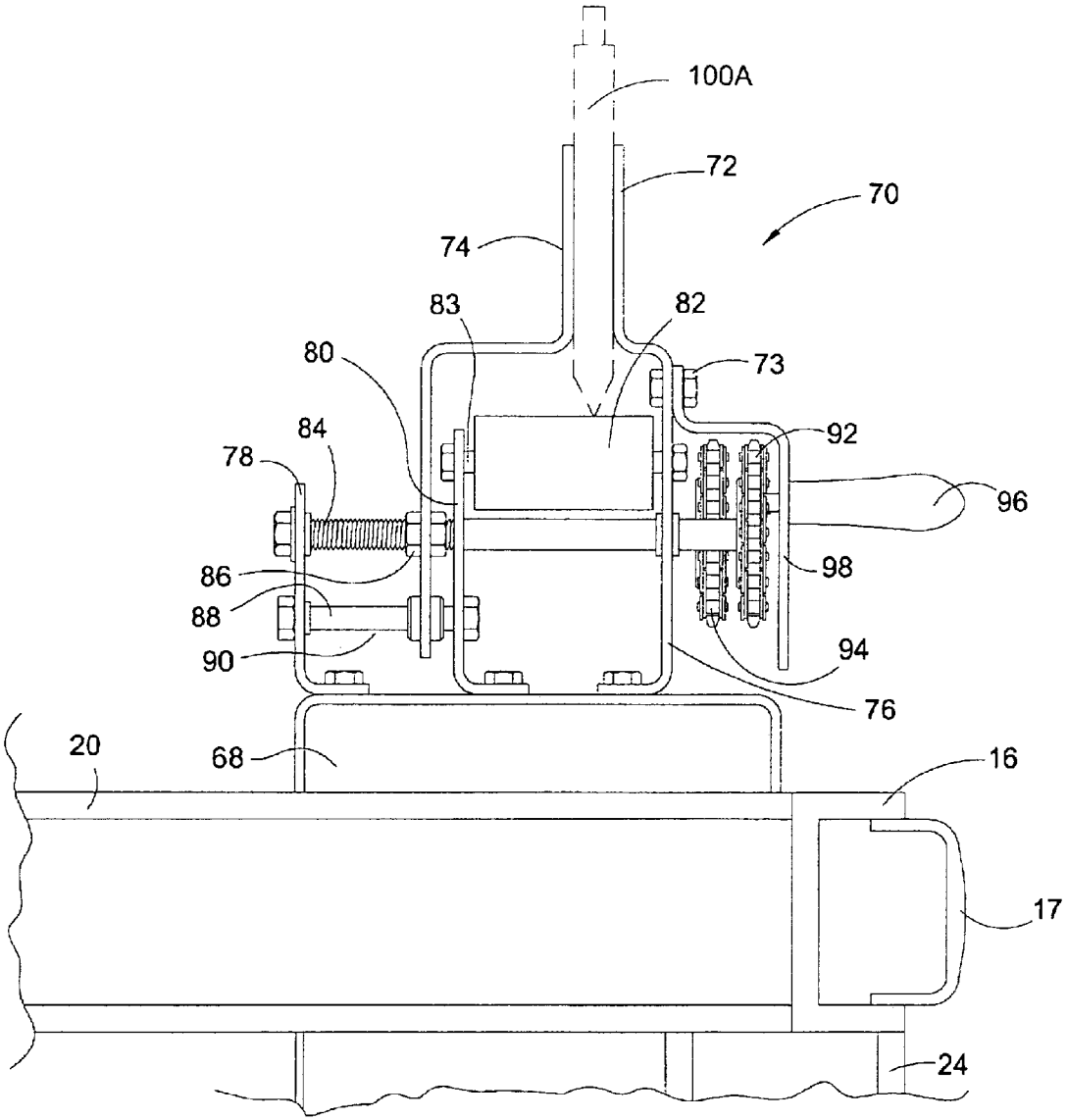
FIG. 4 redepicts FIG. 3, showing the mechanism carrying and supporting an alternate press brake punch.

Referring simultaneously to FIGS. 3, 4, and 6, upon removal of press brake punch 100, an operator may grasp and turn handle 96 counter-clockwise. Such counter-clockwise turning motion rotates both sprocket 92 and helically threaded shaft 84 counter-clockwise. The counter-clockwise rotating motion of helically threaded shaft 84 draws helically threaded nut 86 leftwardly, drawing wall 74 leftwardly to the position depicted in FIG. 4. Such motion of wall 74 is guided and supported by slide shafts 88 and slide sleeves 90. Through the action of the longitudinally extending continuous loop drive chains 94 and 95, the other two jack screw shafts 84 depicted in FIG. 1 are simultaneously actuated, keeping walls 72 and 74 in parallel alignment. Upon such lateral repositioning of wall 74 with respect to wall 72, walls 74 and 72 are capable of supporting the relatively narrow press brake punch 10A.

Figure 5:
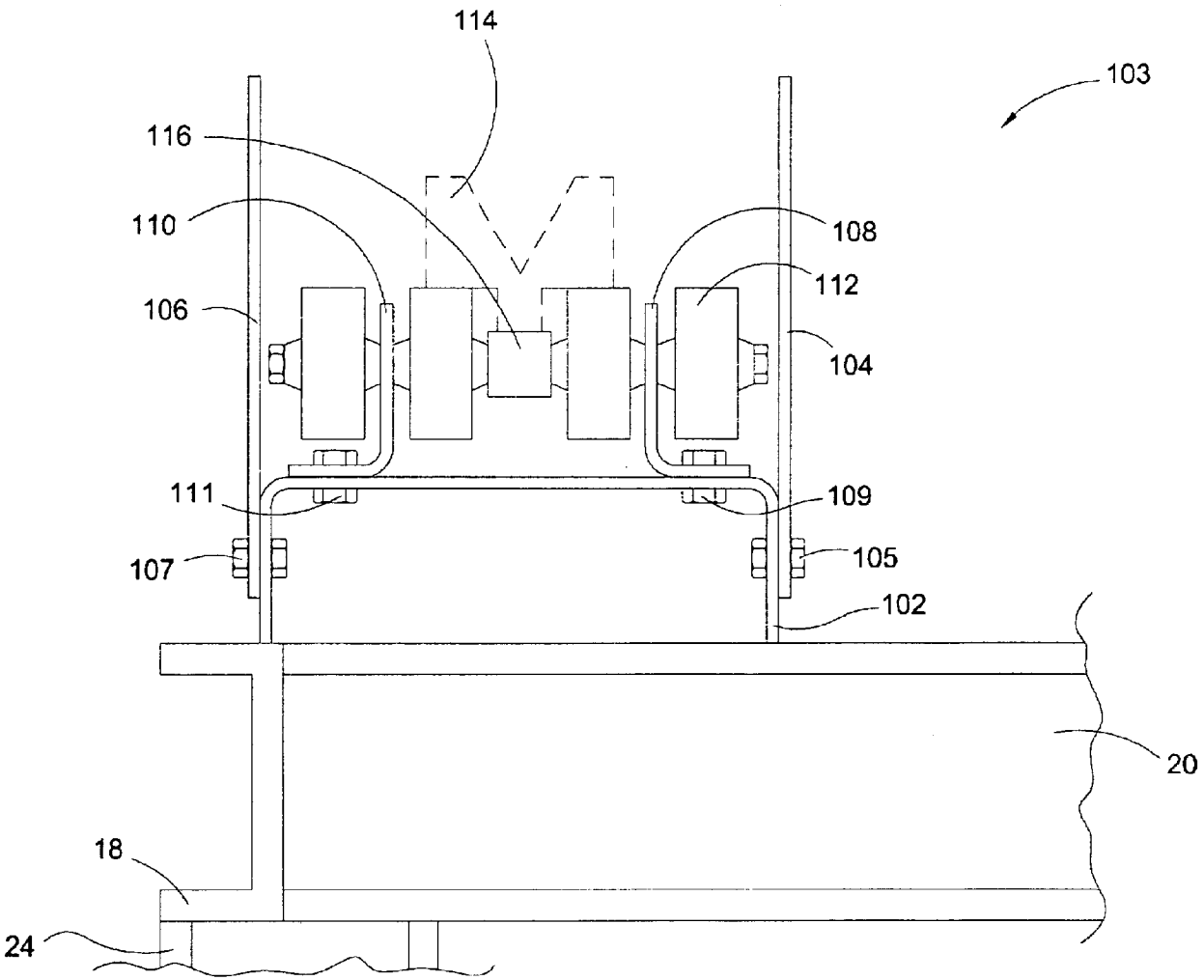
FIG. 5 is a magnification of an alternate portion of FIG. 2.

Referring simultaneously to FIGS. 1, 2, and 5, a press brake die support bed is preferably additionally provided, such bed being designated generally by Reference Arrow 103. The press brake die support bed 103 preferably includes a longitudinally extending "C" channel beam 102 mounted upon longitudinally extending members 18 and 28, longitudinally extending roller supporting flanges 108 and 110 mounted upon longitudinally extending "C" channel beam 102 by bolts 109 and 111, and a plurality of rollers 112 and 116, which are rotatably mounted upon and span between roller supporting flanges 108 and 110. Longitudinally extending guard walls 104 and 106 are preferably mounted upon the longitudinally extending "C" channel beam 102 by bolts 105 and 107. Rollers 112 and 116 support, carry, and laterally convey press brake dies 114, holding such dies in stable equilibrium. Referring simultaneously to FIGS. 2 and 6, the vertical distance between the upper surfaces of rollers 112 and the lower surfaces of wheels 30 is preferably equal to the elevation of the lower shoe of a press brake machine (not depicted) served by the carriage 1 over the upper surfaces of roller tracks (not depicted) carrying the carriage 1.

Referring to FIG. 2, in operation of the instant inventive press brake punch transfer carriage, manually pushing or pulling of handles 17 laterally rolls the carriage 1 for lateral positioning with respect to storage racks (not depicted), or with respect to a press brake machine (not depicted). Referring simultaneously to FIGS. 1, 2, and 6, alternate upwardly and downward actuation of screw actuated telescoping quills 42 and 58 raises and lowers the press brake punch bed 70 for vertical alignment of a carried press brake punch 100 with the upper shoe of a press brake machine (not depicted).

Referring simultaneously to FIGS. 3, 4, and 6, rotation and counter-rotation of turn handle 96 adjusts the lateral displacement of wall 74 with respect to wall 76, allowing accommodation and upright support of press brake punches having varying widths such as press brake punch 100 and press brake punch 100A.

Referring simultaneously to FIGS. 1, 2, and 3, rollers 82 facilitate longitudinal conveyance of press brake punches, while rollers 112 facilitate longitudinal conveyance of press brake dies 114.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An apparatus for press brake punch transfer comprising:

(a) a carriage having lateral sides, and having longitudinal ends;

(b) first conveying means operatively connected to the carriage, said means being adapted for facilitating lateral motion of the carriage;

(c) a press brake punch support bed having lateral sides, and having longitudinal ends;

(d) first bed mounting means interconnecting the press brake punch support bed and the carriage, said means comprising second conveying means adapted for facilitating vertical motion of the press brake punch support bed;

(e) third conveying means adapted for facilitating longitudinal press brake punch movement, the press brake punch support bed comprising the third conveying means;

(f) a plurality of stops defining, in combination with the press brake punch support bed, a press brake punch support channel, said channel having a lateral width, at least a first stop among the plurality of stops having a position with respect to said bed; and, (g) channel width adjusting means operatively connected to at least a first stop among the plurality of stops, said means being adapted for alternately increasing and decreasing the press brake punch support channel's lateral width, and for laterally displacing said at least first stop from said position.

2. The apparatus of claim 1 wherein the carriage comprises a rigid frame.

3. The apparatus of claim 2 wherein the first conveying means comprises a plurality of wheels or a plurality of skids.

4. The apparatus of claim 2 wherein the third conveying means comprises a plurality of rollers or skids.

5. The apparatus of claim 4 wherein the plurality of stops comprises laterally paired and longitudinally extending walls.

6. The apparatus of claim 1 further comprising a press brake die support bed having lateral sides, and having longitudinal ends; further comprising second bed mounting means interconnecting the press brake die support bed and the carriage; and further comprising fourth conveying means adapted for facilitating longitudinal press brake die movement, the press brake support bed comprising the fourth conveying means.

7. The apparatus of claim 6 wherein the carriage comprises a rigid frame.

8. The apparatus of claim 7 wherein the first conveying means comprises a plurality of wheels or a plurality of skids.

9. The apparatus of claim 8 wherein the third and fourth conveying means comprise pluralities of rollers or skids.

10. The apparatus of claim 9 wherein the plurality of stops comprises a laterally paired and longitudinally extending walls.

* * * * *